US005936655A

United States Patent [19]

Biedermann

[11] Patent Number: 5,936,655

[45] **Date of Patent: *Aug. 10, 1999**

[54] METHOD AND APPARATUS FOR PREVENTING PAPER JAMS IN THERMAL PRINTERS

[75] Inventor: David A. Biedermann, Austin, Tex.

[73] Assignee: Dresser Industries, Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,329

[22] Filed: Nov. 19, 1996

[51] Int. Cl.[6] ..... G03G 21/00

[52] U.S. Cl. ..... 347/218; 400/708

[58] Field of Search ..... 347/215, 218; 400/708, 706, 703, 630; 399/20, 21; 355/203

[56] References Cited

U.S. PATENT DOCUMENTS

| | | | |
|---|---|---|---|
| 3,931,497 | 1/1976 | Gentile et al. | 235/381 |
| 4,560,990 | 12/1985 | Sue et al. | 358/304 |
| 4,900,173 | 2/1990 | Okamura | 400/708 |
| 5,228,792 | 7/1993 | Crevecoeur et al. | 400/630 |
| 5,361,216 | 11/1994 | Warn et al. | 364/509 |
| 5,459,553 | 10/1995 | Kim | 399/20 |
| 5,557,529 | 9/1996 | Warn et al. | 364/479 |

*Primary Examiner*—N. Le
*Assistant Examiner*—Anh T. N. Vo
*Attorney, Agent, or Firm*—Haynes & Boone, LLP

[57] ABSTRACT

Method and apparatus for preventing paper jams in thermal printers are disclosed. A thermal printer of the present invention includes a motor for advancing the free end of a roll of paper between a thermal print head and a roller in a conventional manner. A controller provides control signals to the motor for controlling the amount and direction of movement of the motor. A sensor is positioned just beyond the thermal print head for detecting the presence of paper thereunder and for providing a paper detect signal indicative of same to the controller via an appropriate interface. Upon the elapse of a predetermined time period, the controller reads the paper detect signal generated by the sensor and, if the signal indicates that paper is detected by the sensor, the controller causes the motor to retract the paper. Conversely, if the paper detect signal indicates that paper is not detected under the sensor, the controller causes the motor to advance the paper so that it is detected by the sensor. If a paper jam occurs, a message is sent to an operating system to notify an attendant to take remedial action.

15 Claims, 2 Drawing Sheets

METHOD AND APPARATUS FOR PREVENTING PAPER JAMS IN THERMAL PRINTERS

BACKGROUND OF THE INVENTION

The invention relates generally to thermal printers, especially those associated with fuel dispensers, and, more particularly, to the prevention of paper jams in such printers.

Dispensers for gasoline and other fuels have undergone many advances in technology. For example, most modem fuel dispensers are electrically connected to an operating system installed on a computer within the gas station office to enable a customer to pay for the fuel at the dispenser itself using a credit or debit card. Moreover, modern dispensers may also include electronic displays for showing sales data, including price-per-gallon, number of gallons dispensed, and amount of payment due, as well as brief advertisements for services such as car washes. Accordingly, a conventional fuel dispenser system will typically include an external point-of-sale ("POS") controller and a fuel dispenser with various electronics including a magnetic card reader for reading the magnetic stripe of a credit or debit card swiped therethrough, a thermal printer for printing receipts in connection with card purchases, an electronic display, such as an LCD, and a pump controller.

As previously indicated, a modern fuel dispenser typically includes a thermal printer for printing credit and debit card receipts in connection with so-called "pay-at-the-pump" transactions. In a conventional thermal printer, a continuous sheet of paper is stored in a roll and the free end thereof is passed between a roller and a thermal print head. The print head holds the paper against the roller, while simultaneously imprinting the appropriate characters thereon. The printer is contained within a housing having an exit through which the printed receipt exits the printer and is made available to customer.

The paper used with thermal printers is chemically treated and, at high temperatures and high humidity, such as might exist in an unprotected environment, such as a fuel dispenser, can become sticky. If the paper sits in the printer for a long periods of time, for example, 2 to 3 hours, without being moved, it will become difficult, if not impossible, for the motor of the thermal printer to advance the paper, thereby rendering it impossible to provide a purchaser with a receipt, as the coating of the paper will have become adhered to the print head. The obvious result of the foregoing is a paper jam. In view of the fact that many purchasers save such receipts for their records, as well as to reconcile their card statement each month, this situation is unacceptable.

Therefore, what is needed is a method and apparatus for preventing paper jams in thermal printers, especially those installed in fuel dispensers.

SUMMARY OF THE INVENTION

The foregoing problems are solved and a technical advance is achieved by a method and apparatus for preventing paper jams in thermal printers. In a departure from the art, a thermal printer is provided with a system for periodically moving the paper back and forth across the thermal print head of the printer, thereby preventing the paper from sticking to the print head and jamming the printer.

In a preferred embodiment, the improved thermal printer of the present invention includes a motor for advancing the free end of a roll of paper between a thermal print head positioned above the paper for printing characters thereon and a roller in a conventional manner. A controller provides control signals to the motor for controlling the amount and direction of movement of the motor. The controller also provides control signals to the thermal print head for controlling the characters imprinted on the paper. A sensor is positioned just beyond the thermal print head for detecting the presence of paper thereunder and for providing a paper detect signal indicative of same to the controller via an appropriate interface.

In one aspect of the invention, upon the elapse of a predetermined time period, the controller reads the paper detect signal generated by the sensor and, if the signal indicates that paper is detected by the sensor, the controller sends a control signal to the motor instructing it to retract the paper. Conversely, if the paper detect signal indicates that paper is not detected under the sensor, the controller sends a control signal to the motor instructing it to advance the paper so that it is positioned under the sensor. In this manner, the paper is "jiggled" under the print head such that it is not given the opportunity to become stuck thereto.

In another aspect of the invention, the controller is electrically connected to an operating system, which may be on-site or remote. In this aspect, if it is determined that the paper has not been retracted or advanced, indicating that a paper jam has occurred, a signal is sent to the operating system to provide an indication of the paper jam to a system manager.

A technical advantage achieved with the present invention is that it prevents paper jams from occurring in thermal printers.

Another technical advantage achieved with the present invention is that, if a paper jam does occur, it provides a notice of the paper jam such that remedial measures can be taken.

DETAILED DESCRIPTION OF THE PREFERRED EMBODIMENT

Figure 1:
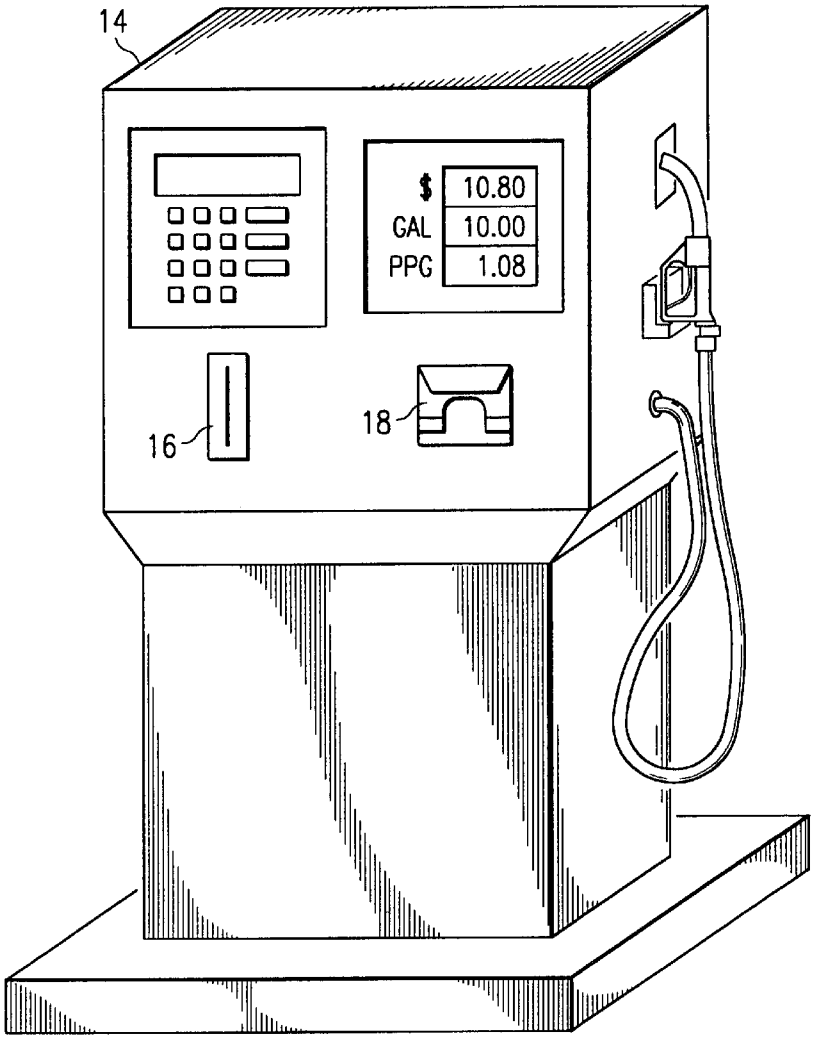
FIG. 1 is a pictorial view of a conventional gas station having a fuel dispenser in which a thermal printer embodying features of the present invention is installed.
Figure 1:
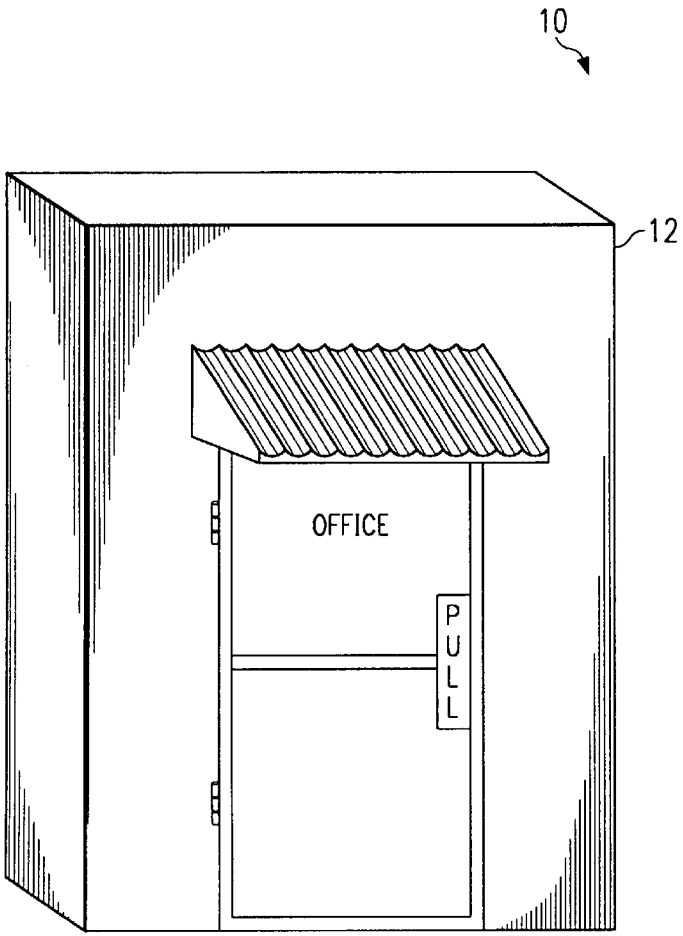

FIG. 1 illustrates a conventional gas station 10 having an office 12 and a fuel dispenser 14. In a preferred embodiment, the fuel dispenser 14 includes a magnetic card reader 16 for enabling a fuel purchaser to "pay-at-the-pump" for a fuel purchase. A receipt for such payment is printed by a thermal printer (FIG. 2) internal to the dispenser 14 and output via an opening 18 comprising an output of the printer (FIG. 2).

Figure 2:
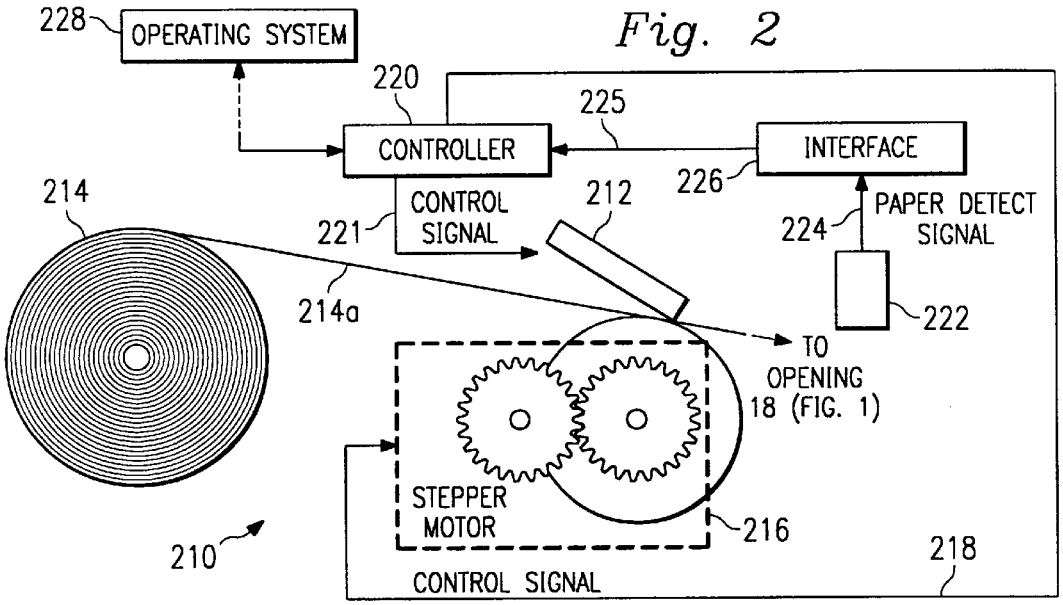
FIG. 2 is a block diagram of a thermal printer embodying features of the present invention.

FIG. 2 is a block diagram of a thermal printer system 210 embodying features of the present invention. In a preferred embodiment, the printer system 210 is installed in a fuel dispenser, such as the dispenser 14. The printer system 210 comprises a thermal print head 212, a roll of chemically treated paper 214 and a motor 216 for moving the free end 214*a* of the paper 214 under the print head 212. As will be hereinafter described in detail, the direction and amount of movement of the paper end 214*a* is controlled by a control signal 218 generated by a controller 220 to the motor 216. The controller 220 also transmits a control signal 221 to the print head 212 for controlling what is printed by the print head on the paper 214.

In accordance with the features of the present invention, a sensor 222, which may be, for example, an optical sensor, is provided just beyond the thermal print head 212 proximate the opening 18 (FIG. 1) through which the paper exits the printer 210. The sensor 222 detects the whether the paper end 214*a* is positioned under the sensor 222 and generates a paper detect signal 224 indicative thereof to an interface 226. The interface 226 converts the signal 224 from an analog signal to a digital signal, which digital signal is transmitted to the controller 220 via a line 225 for purposes that will be described in detail with reference to FIG. 3.

In another aspect of the invention, the controller 220 is electrically connected to an operating system 228, which may reside, for example, on a computer (not shown) located inside the office 12 (FIG. 1). In this manner, messages generated by the controller 220 may be transmitted to an attendant inside the office 12.

Figure 3:
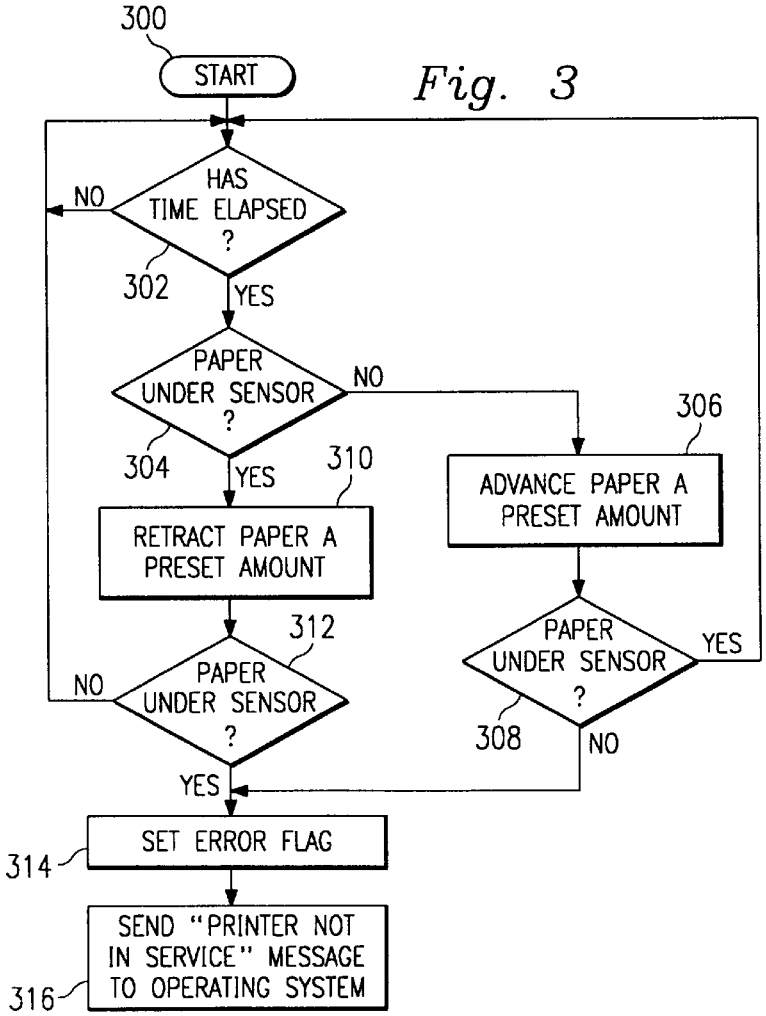
FIG. 3 is a flowchart of the operation of the thermal printer of FIG. 2 in accordance with the present invention.

FIG. 3 is a flowchart of the operation of the system 210 of the present invention. It should be recognized that instructions for implementing the method shown in FIG. 3 may be stored in the controller 220. Execution begins in step 300. In step 302, a determination is made whether a predetermined time period has elapsed since the last time the paper detect signal was read by the controller 220. If not, remains at step 302. Once it is determined, in step 302, that the predetermined time period has elapsed, execution proceeds to step 304. In step 304, a determination is made whether the paper detect signal 224 indicates that there is paper under the sensor 222. If not, execution proceeds to step 306, in which the controller 220 signals the motor 216 to advance the paper 214 a preset amount, and then to step 308, in which a determination is again made, by reading the paper detect signal 224, whether the paper 214 is under the sensor 222. If in step 308 it is determined that paper 214 is detected under the sensor 222, execution returns to step 302.

If in step 304, it is determined that paper 214 is detected under the sensor 222, execution proceeds to step 310, in which the controller 220 directs the motor 216 to retract the paper a preset amount, and then to step 312, in which a determination is again made whether paper is detected under the sensor. If in step 312 it is determined that there is no paper under the sensor 222, indicating that the paper 214 has been successfully retracted in step 310, execution returns to step 302.

If in step 308 it is determined that paper is not detected under the sensor 222, indicating that the paper 214 was not successfully advanced in step 306, or if in step 312 it is determined that there is paper under the sensor, indicating that the paper was not successfully retracted in step 310, execution proceeds to step 314. It will be recognized that if a positive determination is made in step 312 or a negative determination is made in step 308, the printer 210 is jammed. In step 314, an error flag is set and execution proceeds to step 316, in which a "PRINTER NOT IN SERVICE" message is sent to the operating system 228 for notifying an attendant that remedial action is necessary.

In the foregoing manner, paper jams can be prevented from occurring in thermal printers.

Although illustrative embodiments of the present invention have been shown and described, a latitude of modification, change and substitution is intended in the foregoing disclosure, and in certain instances, some features of the invention will be employed without a corresponding use of other features. For example, it is not necessary that the thermal printer be installed in a fuel dispenser, the apparatus and method of the present invention being applicable to any thermal printer application. Moreover, the operating system228 may be located on-site, i.e., within the office 12, or at a remote location. Accordingly, it is appropriate that the appended claims be construed broadly and in a manner consistent with the scope of the invention.

What is claimed is:

1. A method of preventing paper jams in a printer comprising a roller, a print head and motor for advancing and retracting paper passed between said print head and said roller, the method comprising:

providing a sensor between said print head and an opening comprising an output of said printer for detecting a presence or an absence of the paper;

responsive to said paper being detected by said sensor and lapse of a predetermined time, generating a first control signal to said motor for instructing said motor to retract said paper a first predetermined distance; and responsive to said paper not being detected by said sensor and lapse of said predetermined time, generating a second control signal to said motor for instructing said motor to advance said paper a second predetermined distance;

wherein retraction and advancement motion occurs periodically and reduces adhesion between the paper and the print head to prevent said paper jams from occurring.

2. The method of claim 1 further comprising, subsequent to said generating the first control signal responsive to said paper remaining detected by said sensor and a time period greater than said predetermined time period having elapsed, sending a message to an operating system installed on a computer system to which said printer is electrically connected that a paper jam has occurred.

3. The method of claim 1 further comprising, subsequent to said generating the second control signal responsive to said paper remaining undetected by said sensor and a time period greater than said predetermined time period having elapsed, sending a message to an operating system installed on a computer system to which said printer is electrically connected that a paper jam has occurred.

4. The method of claim 1 wherein said printer is a thermal printer and said print head is a thermal print head.

5. Apparatus for preventing paper jams in a printer comprising a roller, a print head and motor for advancing and retracting paper passed between said print head and said roller, the apparatus comprising:

a controller electrically connected to said motor for controlling a direction and distance of movement of said paper by said motor;

a sensor electrically connected to said controller and positioned between said print head and an opening comprising an output of said printer, for detecting a presence or an absence of the paper and generating a paper detect signal indicative of said detecting to said controller at predetermined time intervals;

wherein when said paper is detected by said sensor, said controller instructs said motor to retract said paper a first predetermined distance; and wherein when said paper is not detected by said sensor, said controller instructs said motor to advance said paper a second predetermined distance;

thereby causing a periodically occurring retraction and advancement motion which reduces any adhesion between the paper and print head and prevents said paper jams.

6. The apparatus of claim 5 further comprising an operating system electrically connected to said controller, wherein responsive to said motor failing to advance or retract said paper as instructed by said controller, a paper jam message is sent to said operating system.

7. The apparatus of claim 5 wherein said printer is a thermal printer and said print head is a thermal print head.

8. The apparatus of claim 5 wherein said paper is chemically treated.

9. Apparatus for preventing paper jams in a printer comprising a roller, a print head and motor for advancing and retracting paper passed between said print head and said roller, the apparatus comprising:

control means electrically connected to said motor for controlling a direction and distance of movement of said paper by said motor and determining a lapse of time from when the control means last read a paper detect signal;

sensing means electrically connected to said control means and positioned between said print head and an opening comprising an output of said printer, for detecting a presence or an absence of said paper and generating the paper detect signal indicative of said detecting to said control means;

wherein responsive to said paper being detected by said sensing means and said lapse of time expiring, said motor retracts said paper a first predetermined distance to reduce adhesion between the print head and the paper; and wherein responsive to said paper not being detected by said sensing means and said lapse of time expiring, said motor advances said paper a second predetermined distance to reduce further adhesion between the print head and the paper.

10. The apparatus of claim 9 wwherein said control means is also for sending a message to an operating system that a paper jam has occurred responsive to said paper not having been retracted the first predetermined distance;

wherein said control means determines that said paper has not retracted said first predetermined distance by determining that a time period greater than said lapse of time has occurred and that said paper remains detected by said sensing means.

11. The apparatus of claim 9 wherein said control means is also for sending a message to an operating system that a paper jam has occurred responsive to said paper not having been advanced the predetermined;

wherein said control means determines that said paper has not advanced said second predetermined distance by determining that a time period greater than said lapse of time has occurred and that said paper remains undetected by said sensing means.

12. Apparatus for preventing paper jams in a fuel dispenser having a thermal printer, the apparatus comprising:

a roller;

a print head for retaining paper against said roller and for imprinting characters on said paper;

a motor for advancing and retracting said paper between said print head and said roller;

a controller electrically connected to said roller and said motor for controlling a direction and distance of movement of said paper by said motor relative to said print head and for determining whether a predetermined time period has elapsed;

a sensor electrically connected to said controller and positioned between said print head and a paper output of said fuel dispenser for detecting whether or not the paper is proximate thereto and generating a paper detect signal indicative of results of said detecting to said controller;

wherein the controller, after the predetermined time period has elapsed, reads the paper detect signal and instructs said motor to either retract or advance the paper a predetermined distance causing a periodic motion between said paper and said print head to occur.

13. The apparatus of claim 12 further comprising an operating system electrically connected to said controller, wherein responsive to said motor failing to advance said paper as instructed by said controller as indicated by said paper not being detected by said sensor subsequent to said instruction, a paper jam message is sent to said operating system.

14. The apparatus of claim 12 wherein said printer is a thermal printer and said print head is a thermal print head.

15. The apparatus of claim 12 further comprising an operating system electrically connected to said controller, wherein responsive to said motor failing to retract said paper as instructed by said controller as indicated by said paper being detected by said sensor subsequent to said instruction, a paper jam message is sent to said operating system.

* * * * *